US007077933B2

(12) United States Patent
Otani et al.

(10) Patent No.: US 7,077,933 B2
(45) Date of Patent: Jul. 18, 2006

(54) PULP MOLDED BODY

(75) Inventors: Kenichi Otani, Tochigi (JP); Yoshiaki Kumamoto, Tochigi (JP)

(73) Assignee: Kao Corporation, Tokyo (JP)

( * ) Notice: Subject to any disclaimer, the term of this patent is extended or adjusted under 35 U.S.C. 154(b) by 337 days.

(21) Appl. No.: 10/204,859

(22) PCT Filed: Feb. 27, 2001

(86) PCT No.: PCT/JP01/01465

§ 371 (c)(1),
(2), (4) Date: Aug. 26, 2002

(87) PCT Pub. No.: WO01/64527

PCT Pub. Date: Sep. 7, 2001

(65) Prior Publication Data

US 2003/0029591 A1 Feb. 13, 2003

(30) Foreign Application Priority Data

Mar. 1, 2000 (JP) ..... 2000-056537

(51) Int. Cl.
*D21F 13/00* (2006.01)
*D21J 1/00* (2006.01)

(52) U.S. Cl. ..... 162/218; 162/221; 162/224; 162/230; 162/231

(58) Field of Classification Search ..... 162/218, 162/221, 224, 230, 231
See application file for complete search history.

(56) References Cited

U.S. PATENT DOCUMENTS

| | | | | |
|---|---|---|---|---|
| 2,961,043 | A * | 11/1960 | Hicks | 162/401 |
| 5,356,518 | A * | 10/1994 | Kelley et al. | 162/224 |
| 6,454,906 | B1 | 9/2002 | Nonomura et al. | |
| 6,461,480 | B1 | 10/2002 | Otakura et al. | |
| 6,468,398 | B1 * | 10/2002 | Kumamoto et al. | 162/220 |

FOREIGN PATENT DOCUMENTS

| | | |
|---|---|---|
| GB | 242995 | 7/1926 |
| GB | 452959 | 9/1936 |
| JP | 55-8139 | 1/1980 |
| JP | 19947/1987 | 2/1987 |
| JP | 5-139433 | 6/1993 |
| JP | 8-302600 | 11/1996 |
| JP | 2000-25733 | 1/2000 |

* cited by examiner

*Primary Examiner*—Mark Halpern
(74) *Attorney, Agent, or Firm*—Oblon, Spivak, McClelland, Maier & Neustadt, P.C.

(57) ABSTRACT

A pulp molded article (1) of the present invention comprises a neck portion (2) and a thread (5) provided on the outer surface of the neck portion (2), and has an overrun torque of 1 N·m or higher between the neck portion and a threaded cap screwed on the neck portion (2).

22 Claims, 4 Drawing Sheets

20
21
21
24
26
22
23
23
1'

20
26
22
24
1'

20
24
26
22
1'

PULP MOLDED BODY

This application is a 371 of application PCT/JP01/01465 filed 27 Feb. 2001.

This application is based upon and claims the benefit of priority under 35 U.s.c. §120 from application No. PCT/JP01/01465, filed Feb. 27, 2001, and under 35 U.S.C. §119 from Japanese Patent Application No. 2000-056537, filed Mar. 1, 2000.

TECHNICAL FIELD

The present invention relates to a pulp molded article which has a threaded part and assures a good seal with a cap. More particularly, it relates to a pulp molded article with a threaded part which part is an accurate reproduction of a molding surface of a mold. The present invention also relates to a method of producing the pulp molded article.

BACKGROUND ART

Pulp containers with a threaded part which are prepared by forming a thread on a paper cylinder by a calender press are known. However, the shapes of the threads and containers formed by a calender press are limited in nature of the method adopted only to provide a poor seal with a cap, allowing the contents to leak during use. In addition, the paper cylinder itself is not strong enough to assure durability for repeated capping and uncapping.

JP-A-8-302600 discloses a pulp molded article having on its surface a projection such as a thread. The projection is attached with an adhesive, etc. in a separate step or formed in the step of drying a molded article. The method of forming a projection in the step of drying is advantageous for efficient production of molded articles since the step of making a projection and the step of attaching the projection are carried out on the same molding line. Where a projection is formed in a drying step, however, cases are met with, while depending on the shape of the projection, in which the depression on the molding surface of a mold is not accurately transferred only to make a rounded projection or a projection with a rough surface, or the resulting projection fails to have an increased density for securing sufficient strength.

DISCLOSURE OF THE INVENTION

Accordingly, an object of the present invention is to provide a pulp molded article with a threaded part which assures a good seal with a cap.

Another object of the present invention is to provide a pulp molded article with a threaded part which has high durability for repeated capping and uncapping.

Still another object of the present invention is to provide a pulp molded article with a threaded part which part is an accurate reproduction of a depression on the molding surface of a mold and has sufficient strength.

The present invention accomplishes the above objects by providing a pulp molded article comprising a neck portion and a thread provided on an outer surface of the neck portion, and having an overrun torque of 1 N·m or higher between the neck portion and a threaded cap screwed on the neck portion.

The present invention provides a preferred method for producing a pulp molded article having a thread at the neck portion thereof. In the method of the present invention, a papermaking mold having a threaded part at the region corresponding to the neck portion of the above pulp molded article is employed. The method comprises the step of papermaking with the above papermaking mold to form a pulp molded article comprising a neck portion and a thread provided on the outer surface of the neck portion.

BRIEF DESCRIPTION OF THE DRAWINGS

FIG. 6(*b*) shows the step of dewatering by feeding a pressurizing fluid. FIG. 6(*c*) shows the step of opening a papermaking mold.

FIG. 7(*b*) shows the step of heat drying. FIG. 7(*c*) shows the step of opening a heating mold.

BEST MODE FOR CARRYING OUT THE INVENTION

Figure 1:
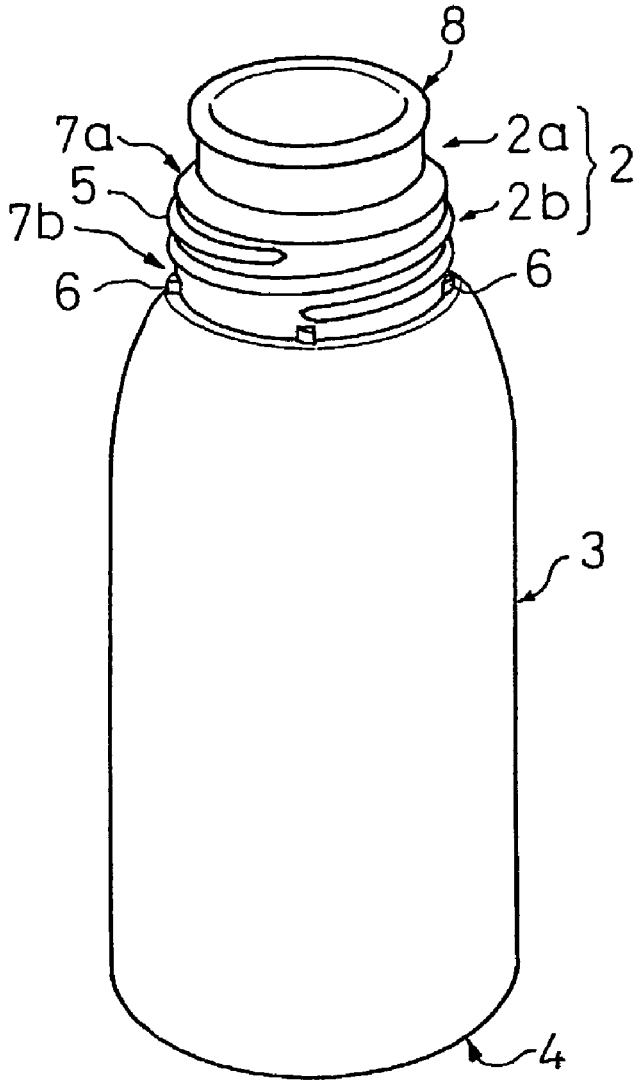
FIG. 1 is a perspective showing an embodiment of the pulp molded article according to the present invention.
Figure 2:
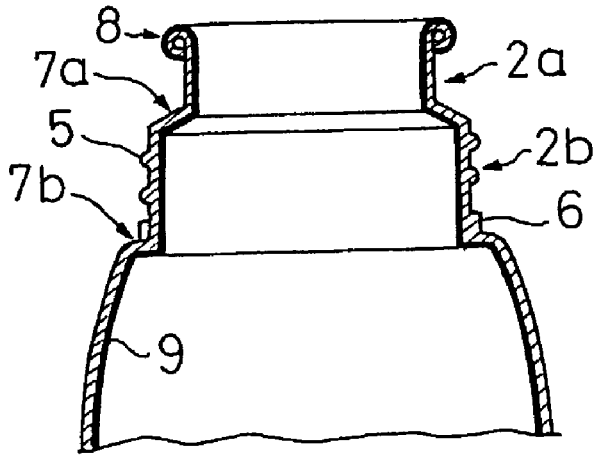
FIG. 2 is an enlarged cross-section of the neck of the pulp molded article shown in FIG. 1.
Figure 3:
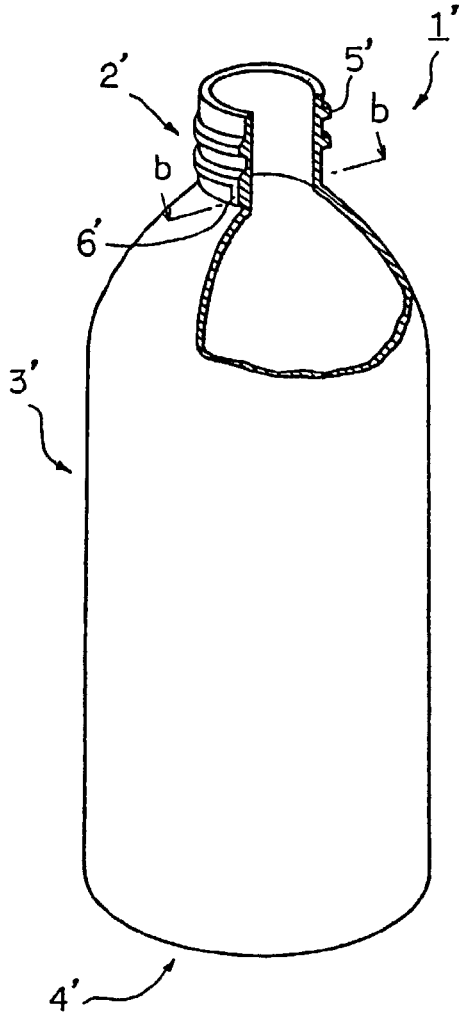
FIG. 3 is a perspective showing another embodiment of the pulp molded article according to the present invention, with a part cut away.

The present invention will be described based on its preferred embodiments with reference to the accompanying drawings. FIG. 1 is a perspective view of a pulp molded article 1. FIG. 2 gives an enlarged cross-sectional view of the neck portion thereof FIG. 3 is a perspective view of a pulp molded article 1' according to another embodiment different from FIG. 1, with a part cut away. The molded articles 1 and 1' each have a cylindrical shape comprising an open neck 2 or 2' in the upper portion thereof, a body 3 or 3', and a bottom 4 or 4'. The necks 2 and 2' have a smaller diameter than the respective bodies 3 and 3'.

The molded articles 1 and 1' form right angles between their bodies 3 and 3' and bottoms 4 and 4'. That is, the bodies 3 and 3' have a taper angle of 0°. The molded articles 1 and 1' are at least 50 mm high, preferably at least 100 mm high. For some uses of the molded articles 1 and 1', the bodies 3 and 3' do not need to make right angles with their bottoms 4 and 4'.

The molded articles 1 and 1' have no seams nor thicker-walled parts which might have resulted from joining and therefore ensure sufficient strength and a good appearance.

In the molded article 1 shown in FIG. 1, the neck 2 has a first neck portion 2*a* on the side of its edge and a second neck portion 2*b* which is between the first neck portion 2*a* and the body 3 and larger than the first neck portion 2*a* in diameter. The first neck portion 2*a* and the second neck portion 2*b* connect to each other via a first step 7*a*. The second neck portion 2*b* is connected to the body 3 via a second step 7*b*. Thus, the neck 2 is step-shaped. On the other hand, the neck 2' of the molded article 1' shown in FIG. 3 has a straight cylindrical shape.

In the molded article 1 shown in FIG. 1, the first neck portion 2*a* of the neck 2 has a lip 8, formed by curling the edge outward and downward to make one turn. The lip 8 makes a better seal with the reverse face of a cap hereinafter described. As shown in FIG. 2, the inner surface of the molded article 1 is laminated with a resin film 9 to impart water resistance to the molded article 1. The laminating resin film and the lip 8 make the molded article 1 particularly suitable for containing liquid.

The molded articles 1 and 1' are made mainly of pulp. They can be made solely of pulp. Where pulp is used in combination with other materials, the proportion of the other materials is preferably 1 to 70% by weight, still preferably 5 to 50% by weight. Other materials that can be used include inorganic substances such as talc and kaolinite, inorganic fibers such as glass fiber and carbon fiber, powder or fiber of synthetic resins such as polyolefins, non-wood or vegetable fibers, and polysaccharides.

The second neck portion 2*b* of the molded article 1 shown in FIG. 1 has a threaded outer surface having a helical thread 5. The neck 2' of the molded article 1' shown in FIG. 3 also has a threaded outer surface having a helical thread 5'. A cap (not shown) having a thread that meshes with the thread 5 or 5' is screwed on the neck 2 or 2'.

The contour of the thread 5 (5') may be trapezoidal, triangular, squared, rounded, etc. A proper thread contour is chosen according to the strength of the neck 2 (2') and productivity of the molded article 1 (1') (e.g., drying capability or shaping capability of the thread 5 (5')). For example, a rounded thread or a triangular thread is preferred where ease of screwing a cap on and off is of importance or where a cap is screwed on and off frequently. A trapezoidal thread is preferred where a cap is screwed tight with a great torque, where a cap is required to hardly loosen, or where a cap is required to be hardly pulled out. The threads used in the molded articles I and 1' are trapezoidal threads whose contour is a trapezoid as shown in FIG. 5.

With a threaded cap screwed on the neck 2 (2') of the molded article 1 (1'), the overrun torque exerted between the neck 2 (2') and the cap is 1N·m or more, preferably 1.2 N·m or more, still preferably 5 N·m or more. Such designing provides a good seal of the neck 2 (2') with the cap so that the cap hardly loosens even by vibrations during transportation, effectively preventing leakage of the contents contained in the molded article 1 (1'). In particular, the molded article 1 shown in FIG. 1 assures an improved seal with the cap owing to the lip 8 formed on the edge of the opening as mentioned above. The seal of the neck 2 (2') with the cap is improved as the overrun torque becomes higher above 1 N·m. In the practical use, a cap will not overrun where the overrun torque value is 5 N·m. Taking into consideration the production method of the molded articles 1 and 1', the composition of the molded articles 1 and 1', and the like, the maximum overrun torque that could be reached by the state-of-the-art techniques is about 10 N·m. The method of measuring an overrun torque will be described later in Examples.

Figure 5:
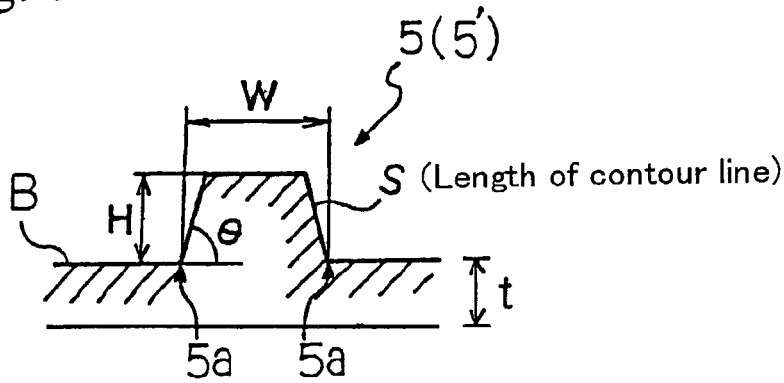
FIG. 5 is a cross-section of a thread along the width direction.

It is preferred for the profile of the threads 5 and 5' to satisfy relationships (1) and (2) or (3) shown below, taking the length of the contour line of the thread observed via a cross-section along its width direction as S (mm), the width of the thread as viewed via a plan as W (mm), and the thickness of the molded articles 1 and 1' (the thickness of the neck in the present embodiment) as t (mm) as illustrated in FIG. 5.

$$1<S/W\leqq 1.5 \quad (1)$$

$$0<W\leqq 10\ t\ (\text{mm}) \quad (2)$$

$$0<W\leqq 10\ \text{mm} \quad (3)$$

If S/W in relationship (1) exceeds 1.5, the thread 5 is liable to be broken during dewatering or drying, or the thread 5 (5') tends to fail to have a smooth surface or an increased density. If W exceeds 10 t (mm) or 10 mm in relationships (2) or (3), it is not easy to accumulate pulp fiber along the depression of a papermaking mold from the viewpoint of available space, considering that a papermaking net is fitted on the papermaking mold. Further, it is not easy to put the preform taken out of the papermaking mold into a heating mold with a good registration.

Relationship (1) is preferably represented by relationship (1') in order to accurately form thread 5 (5') in conformity to the depression of a mold, to prevent the thread 5 (5') from being broken, to improve the surface smoothness of the thread 5 (5'), or to increase the density of the thread 5 (5').

$$1<S/W\leqq 1.3 \quad (1')$$

In the present embodiment the width W of the thread (i.e., the length of the bottom side of the trapezoid) is preferably 0.5 to 10 mm, still preferably 2 to 6 mm, for exerting a sufficient clamping force and enjoying freedom of design (e.g., size and shape) of the molded article 1.

The thickness t (mm) of the molded article 1 (1') (i.e., the thickness of the neck 2 (2')) is determined appropriately according to the use, etc. of the molded article 1 (1') but, in general, preferably ranges from 0.2 to 10 mm, particularly 0.4 to 2 mm. Within this range, the neck 2 (2') will make a better seal with a cap, and durability against frequent opening and closing will be improved further.

The flank angle θ of the thread 5' (see FIG. 5), the rising angle of the flank from the base plane B of the neck 2 (2'), is preferably greater than 0° and smaller than 90°.

If the flank angle exceeds 90°, shaping by expansion of a pressing member hereinafter described is insufficient, and pressing of the preform by the pressing member is insufficient.

Corners 5*a* (see FIG. 5) made by the base plane B of the neck 2 (2') and the flanks are preferably radiused so as to facilitate transfer of the shape of the depression of a heating mold hereinafter described. Specifically, the corners 5*a* preferably have a curvature radius R of 0.1 mm or more, particularly 0.3 to 5 mm. The two corners 5*a* and 5*a* of the thread 5 (5') shown in FIG. 5 may have the same or different curvatures. For example, where the thread 5 (5') contour is not trapezoidal (with equal flank lengths) shown in FIG. 5 (for example, where the thread contour is like truncated sawtooth), the two corners 5*a* often have different curvatures. In either case, it is desirable for each of the two corners 5*a* to have a curvature falling within the above-recited range.

The height H of the thread 5 (5') from the base plane B is appropriately determined taking into account ease of molding the thread 5 (5'), the clamping force between the thread 5 (5') and the cap, etc. In general, the thread 5 (5') preferably has a height H of 0.3 mm or more, particularly 0.3 to 10 mm, especially 0.5 to 4 mm, for producing a sufficient clamping force and assuring ease of opening and closing.

While pulp molded articles having a threaded part of the above-mentioned shape and dimensions have been difficult to produce by conventional methods, they can be produced easily by the preferred method described hereunder.

The effective number of turns of the threaded part is preferably 0.75 or more. With an effective number of turns less than 0.75, a cap screwed on has reduced pull-out strength and a reduced clamping force, tending to fail to provide a sufficient seal. Further, with this preferred effective number of turns, the difference between clamping torque in screwing a cap on the neck 2 (2') and opening torque in screwing the cap off the neck is smaller than that obtained with the neck of a plastic container and a plastic cap measured under the same conditions (as to, for example, the shape and dimensions of the container and the cap). In short, so-called loss of torque is smaller. This means that a cap screwed on a pulp molded container even with a small clamping torque hardly becomes loose and that a pulp molded container can be sealed with a cap with a smaller force without spilling the contents thereby assuring safety as compared with a plastic container.

For obtaining a good seal by screw cap engagement and securing thread durability, the threads per inch as measured according to JIS basic dimensions is preferably 2 to 64/25.4 mm, still preferably 4 to 12/25.4 mm. While an increased number of threads could provide an improved seal, too many turns for clamping reduces convenience in screwing a cap on and off.

Figure 4:
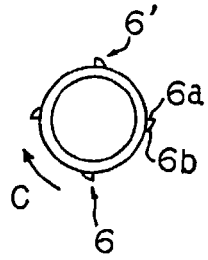
FIG. 4 is a cross-section along line b—b of FIG. 3.

Screw blocking projections 6 are provided near the junction between the second neck portion 2*b* and the second step 7*b* of the molded article 1 shown in FIG. 1, by which excessive engagement between the thread 5 constituting the threaded part of the neck 2 and the thread constituting the threaded part of a cap is prevented. The molded article 1' shown in FIG. 3 also has screw blocking projections 6' near the junction of the neck 2' and the body 3'. The screw blocking projections 6 (6') may be the type to stop a cap on coming into contact the leading end of the cap's thread or the type to stop a cap when the thread of the cap gets over the projection. Since the molded articles 1 and 1' have four threads, four screw blocking projections 6 and 6' are formed at a 90° interval. This design will further be described as for the molded article 1' with reference to FIG. 4. As shown in FIG. 4, each screw blocking projection 6', when observed via a cross section of the neck 2', has a first surface 6*a* which is parallel with the normal of the outer surface of the neck 2' and a second surface 6*b* which connects the first surface 6*a* and the outer surface of the neck 2' depicting a smooth downward slope in the turning direction C of a cap. In mechanically clamping a cap, the screw blocking projections 6 (6') effectively prevent the cap from overrunning. As a result, the torque in mechanically clamping a cap is further increased. Such screw blocking projections 6 (6') are not necessary where a sufficiently high torque is obtained.

It is preferred for the neck 2 (2') inclusive of the thread 5 (5') to have a center-line average roughness Ra (JIS B0601) of 50 μm or less, particularly 25 μm or less, especially 10 μm or less, which favors a better seal of the neck 2 (2') with a cap. The neck 2 (2') with such surface smoothness can be formed by, for example, a prescribed polishing processing technique, but the production method hereinafter described is successful in making the neck 2 (2') with high smoothness without involving such polishing. The smaller the center-line average roughness, the better the seal of the neck 2 (2') with a cap. A minimum center-line average roughness that could be achievable by the state-of-the-art techniques is about 0.1 μm. For the same reason, the largest height Ry (JIS B0601) of the neck 2 (2') inclusive of the thread 5 (5') is preferably 500 μm or less.

The neck 2 (2') inclusive of the thread 5 (5') preferably has a wax pick grade of 5A or higher, particularly 10A or higher, especially 16A or higher, which is a measure of surface strength characteristics (resistance to picking, resistance to fiber rising during use, and resistance to strength reduction of the neck) measured according to the wax pick method (JIS P8129). With this preferred surface strength, the neck exhibits improved durability against repeated capping and uncapping so that pulp fiber rising, surface picking, paper dust fall-off, and like surface disturbances can be prevented to maintain the appearance of the molded article 1 (1').

In order to obtain the above-recited surface hardness as graded by the wax pick method, a method by adding a synthetic resin or a natural resin either externally or internally can be adopted. Methods of externally adding the resin include laminating the neck 2 (2') inclusive of the thread 5 (5') with a resin film, coating the neck 2 (2') with a resin liquid, and impregnating the neck 2 (2') with a resin liquid, and the like. Methods of internally adding the resin include previous addition of a resin to a pulp slurry as a stock for making the molding article 1 (1'). The resin film includes polyolefin films and polyester films, with polyester shrinkable films being preferred. The resin liquids which can be used for coating or impregnation or the resins which can be previously added to a pulp slurry include liquids containing acrylic resins, styrene resins, polyester resins, polyolefin resins, synthetic rubber resins, vinyl acetate resins, polyvinyl alcohol resins, wax resins, polyacrylamide resins, polyamide epichlorohydrin resins, starch resins, gum resins, viscous resins, epoxy resins, melamine resins, phenolic resins, urea resins, polyurethane resins, fluorine resins, silicone resins, etc. These resin liquids may be used either individually or as a mixture of two or more thereof.

The engagement of the neck 2 (2') of the molded article 1 (1') with a cap is preferably such that the pull-out strength of the cap is 5 N or greater, particularly 10 N or greater, especially 20 N or greater, when the amount of engagement between the screw thread of the neck 2 (2') and that of the cap is 0.5 mm, and the cap is given one turn. With this preferred pull-out strength, the neck 2 (2') secures a better seal with the cap to prevent the contents in the molded article 1 (1') from leaking more effectively. Further, even when the molded article 1 (1') is lifted by the cap, the cap does not come off, and the contents are prevented from leaking. Similarly to the aforementioned overrun torque, the greater the pull-out strength, the better the seal between the neck 2 (2') and the cap. The upper limit of the pull-out strength, which is sufficient for the practical use, is about 700 N, while depending on the method of producing the molded article 1 (1'), the composition of the molded article 1 (1'), and the like. The details of the method of measuring pull-out strength will be described in Examples hereinafter given.

It is preferred that the neck 2 (2') inclusive of the thread 5 (5') has a density of 0.4 to 2.0 g/cm$^3$, particularly 0.6 to 1.5 g/cm$^3$, for assuring durability and sealing properties. The density is calculated from the weight of a cut piece of arbitrary size sliced off the neck 2 (2') and the volume of the piece measured from the size (area) and the thickness.

It is preferred for the neck 2 (2') inclusive of the thread 5 (5') to have a transverse compressive strength of 20 N or higher, particularly 30 N or higher, for preventing the neck 2 (2') from being buckled. The upper limit of the transverse compressive strength, which is sufficient for practical use, is about 500N. For the same effect, it is preferred for the neck 2 (2') to have a vertical compressive strength of 100 N or higher, particularly 300 N or higher. The upper limit of the vertical compressive strength, which is sufficient for practical use, is about 700N. These compressive strengths are measured by using a Tensilon tensile tester at a compression rate of 20 mm/min. It is preferred for the neck 2 (2') to have such drop strength that it does not develop a crack or deformation when dropped once from a height of 1.2 m (JIS Z1703). In measuring the drop strength, the molded article 1 (1') is dropped to land on its neck 2 (2').

It is preferred for the neck 2 (2') inclusive of the thread 5 (5') to have a water vapor transmission rate (JIS Z0208) of 100 g/(m$^2$·24 hrs) or lower, particularly 50 g/(m$^2$·24 hrs) or lower, for assuring preservability of the contents, for example, for preventing a powdered detergent from absorbing moisture and caking.

It is preferred for the molded article 1 (1') according to the present embodiment to have a vertical compressive strength of 100 N or higher, particularly 300 N or higher, for preventing the molded article 1 (1') from being buckled. The upper limit of the vertical compressive strength, which is sufficient for practical use, is about 700 N. The vertical compressive strength is measured in the same manner as described above. It is preferred for the molded article 1 (1') to have such drop strength that it does not develop a crack or deformation when dropped once from a height of 1.2 m (JIS Z1703) to land on its base, neck or side. In measuring the drop strength, the molded article 1 (1') is filled with contents (basically full of water, or filled with a prescribed amount of a commercially available product), and the neck 2 (2') is sealed with a cap.

Figure 6C:
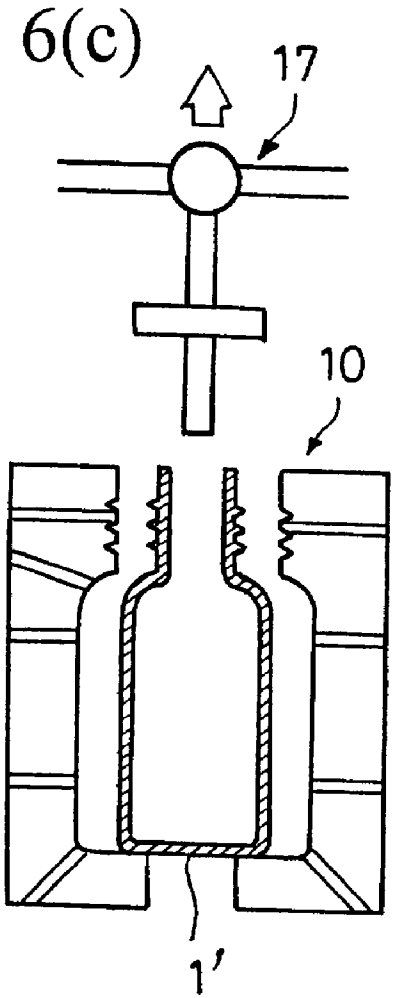
FIG. 6(*a*) shows the step of pouring a pulp slurry.
Figure 6B:
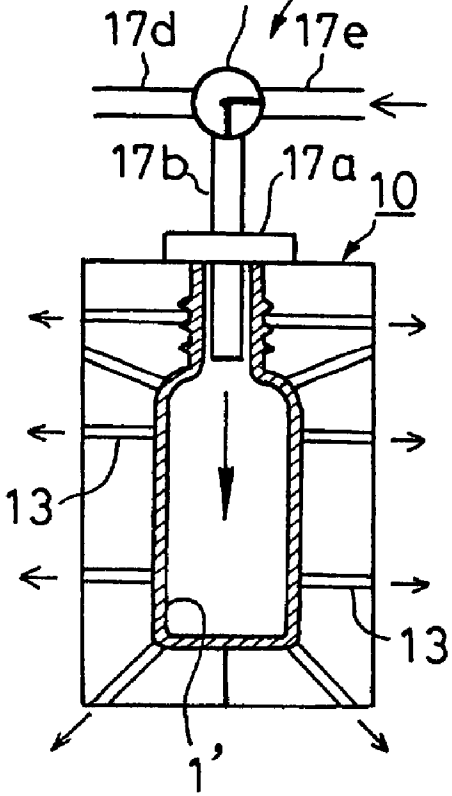
Figure 6A:
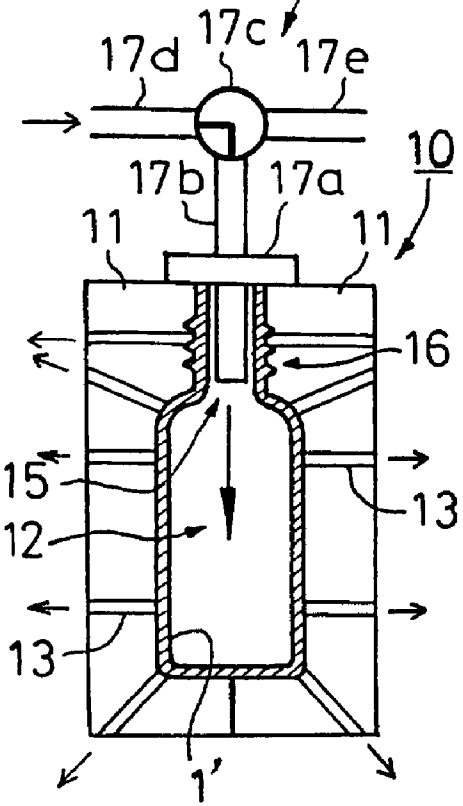

The preferred method of producing a molded article according to the present invention will then be described with particular reference to the production of the molded article 1' shown in FIG. 3 while referring to FIGS. 6(*a*) through 6(*c*). It is a matter of course that the molded article 1 shown in FIG. 1 can be produced by the same method.

According to the method, a papermaking mold having a threaded part in the portion mating with the threaded part of a molded article 1' is used to make a molded article 1' having a threaded part on the outer side of the neck 2'.

In more detail, a papermaking mold 10 is prepared. The papermaking mold 10 is made up of two splits 11 and 11, the splits providing a cavity 12 of prescribed shape on joining. The papermaking mold 10 has a thread 16 on its cavity wall in the portion mating with the thread 5' of the molded article 1' (hereinafter referred to as a mating thread 16). It is desirable for the mating thread 16 to satisfy relationships (4) and (5) described later.

The cavity 12 of the papermaking mold 10 is connected to the outside via a slurry pouring gate 15 open to the outside. The inner side of the cavity 12 is covered with papermaking net having a prescribed mesh size (not shown). Each split 11 has a plurality of interconnecting passageways 13 which connect the inside (i.e., the inner surface of the cavity 12) to the outside. Each interconnecting passageway 13 is connected to a suction means, such as a suction pump (not shown).

In this situation, a feed nozzle 17 is inserted through the slurry pouring gate 15, and a predetermined amount of a pulp slurry is poured into the cavity 12 through the feed nozzle 17. The pulp slurry concentration is usually 0.1 to 5 % by weight. The pulp slurry is either heated or not. Specifically, the temperature of the pulp slurry can range from 0 to 90° C., preferably 10 to 70° C., still preferably 20 to 40° C. To heat the pulp sluny to an elevated temperature is preferred for increasing dewatering efficiency. Simultaneously with pouring the pulp slurry, the cavity 12 is evacuated by suction through the interconnecting passageways 13 toward the outside of the paper making mold 10, whereby the water content of the pulp slurry is sucked up, and pulp fiber is built up on the papermaking net covering the inner wall of the cavity 12. As a result, there is formed a water-containing preform 1' as a deposit of pulp fiber on the papermaking net. A predetermined amount of water (diluent water) can be injected into the cavity 12 in the initial stage and/or the final stage of forming the preform l' to thin the pulp slurry in the cavity 12 so as to prevent thickness unevenness of the preform 1' effectively. The initial stage of forming is the stage when the amount of pulp having been fed into the cavity 12 is not more than 30 %, particularly not more than 20 %, of the total amount of pulp necessary for preform formation. The final stage of forming is the stage when the amount of pulp having been fed into the cavity 12 is at least 70 %, particularly 80 % or more, of the total amount of pulp necessary for preform formation. The amount of diluent water to be fed is preferably such that the concentration of the pulp slurry is reduced to 80 % or lower, particularly 20 to 60 %.

The feed nozzle 17 is used as a means for feeding the pulp slurry and also a pressurizing fluid described later. The feed nozzle 17 has a fitting plate 17*a*, a nozzle 17*b* vertically piercing the fitting plate, a three-way valve 17*c* attached to the upper end of the nozzle 17*b*, and a slurry feed pipe 17*d* and a pressurizing fluid feed pipe 17*e* both connected to the three-way valve 17*c*. On switching the three-way valve 17*c*, the nozzle 17*b* is connected to either the slurry feed pipe 17*d* or the pressurizing fluid feed pipe 17*e*. While the pulp slurry is being poured into the cavity 12, the nozzle 17*b* is connected to the slurry feed pipe 17*d*. The fitting plate 17*a* is fitted into the slurry pouring gate 15 to close the slurry pouring gate 15.

The resulting preform 1' is subjected to a dewatering step. As shown in FIG. 6(*b*), the papermaking mold 10 is sucked from the outside through the interconnecting passageways 13. In this state, with the feed nozzle 17 remaining fixed at the position for papermaking, the three-way valve 17*c* is switched over to connect the nozzle 17*b* to the pressurizing fluid feed pipe 17*d*, and a prescribed pressurizing fluid is supplied from a pressurizing fluid source (not shown) to the cavity 12. As stated previously, since the slurry pouring gate 15 is shut by the fitting plate 17*a*, the cavity 12 is hermetic. The term "hermetic" as used herein does not mean that the cavity 12 is completely hermetic but that the cavity 12 is airtight enough to increase its inner pressure above a specific level described later by introducing a pressurizing fluid. The introduced pressurizing fluid penetrates the preform 1' and is discharged outside through the interconnecting passageways 13.

Pressurizing fluids which can be used include steam and superheated steam (hereinafter inclusively referred to as steam). It is particularly preferred to use superheated steam. By blowing steam, the temperature of water present in the preform 1' rises instantaneously by the heat transfer in condensation of steam thereby to reduce the viscosity and the surface tension of water. As a result, the water content in the preform 1' is blown off instantaneously and very efficiently thereby achieving improved dewatering efficiency. Not relying chiefly on heat exchange, this dewatering technique is extremely energically advantageous. Moreover dewatering completes instantaneously, providing a reduction of dewatering time. Because an elastic pressing member, which is used in the heat drying step hereinafter described, is not used for dewatering, the time for mechanical operations involved in using a pressing member, such as insertion into the cavity, is omitted, resulting in a reduction of the time for mechanical operations. Further, because the blowing pressure is lower than the pressure applied in press dewatering, there is obtained an additional advantage that the papermaking net hardly leaves its marks on the surface of the resulting preform 1' to provide a molded article with a good appearance.

Steam is preferably introduced to increase the inner pressure of the cavity 12 to 98 kPa or greater, particularly 196 kPa or greater, especially 294 kPa or greater. While better results are obtained with a higher inner pressure of the cavity 12, the upper limit of the pressure that pays is about 980 kPa because the water removal efficiency gradually approaches saturation with a pressure increase. The term "(inner) pressure in the cavity 12" as used herein means a difference between the steam pressure at the inlet and that at the outlet of the cavity 12.

It is preferable to start introducing steam while the slurry stays in the cavity 12 or while the diluent water, which has been fed into the cavity 12 in the final stage of forming the preform 1', stays in the cavity 12, whereby the water content in the cavity 12 is expelled out of the mold to shorten the dewatering time. Steam is preferably blown for about 2 to 20 seconds, particularly about 3 to 15 seconds. Dewatering completes in an extremely short time. By this dewatering step, the preform that has had a water content of 75 to 80 % by weight before dewatering is dewatered to a water content of about 40 to 70 % by weight.

Where superheated steam is used, a sufficient degree of superheating is such that the inner pressure of the mold is increased to or above the above-specified value and that the steam is not condensed before being blown into the mold. Steam may be overheated sufficiently, but the dewatering effect is not improved correspondingly.

In addition to the above-mentioned steam, compressed air is also useful as a pressurizing fluid for dewatering the preform 1'. By blowing compressed air, a physical mechanism which does not chiefly rely on heat exchange works to remove the water content from the wet preform 1' instantaneously. Compressed air is preferably blown to increase the pressure of the cavity 12 to 196 kPa or higher, particularly 294 kPa or higher. The upper limit of the pressure is about 1471 kPa for the same reasons as with steam. The time for blowing compressed air is preferably 10 to 60 seconds, particularly 15 to 40 seconds. The pressure (initial pressure) of compressed air is not particularly limited as long as the mold inner pressure may be increased to or above the above-recited level. The detailed description concerning steam appropriately applies to the particulars of compressed air that are not described here.

While steam and compressed air may be used individually, a combined use of both is preferred for dewatering efficiency. It is particularly preferred to introduce steam followed by compressed air for the following reason. If the steam blowing time is long, there can result a large water content variation in the vertical direction of the preform 1'. In order to avoid this, it is effective to first blow steam to sufficiently elevate the temperature of water contained in the preform and then blow compressed air. When steam and compressed air are blown in this order, steam are preferably blown at a pressure of 98 kPa or higher, particularly 196 kPa or higher, especially 294 kPa or higher, for 2 to 20 seconds, particularly 3 to 15 seconds, and compressed air is preferably blown at a pressure of 196 kPa or higher, particularly 294 kPa or higher, for 2 to 25 seconds, particularly 5 to 20 seconds. It is preferred for dewatering efficiency that blowing steam be continuously followed by blowing compressed air.

After the preform 1' is dewatered to a prescribed water content, the feed of the pressurizing fluid is stopped, and the feed nozzle 17 is taken out of the papermaking mold 10 as shown in FIG. 6(*c*). The papermaking mold 10 is opened, and the preform 1' having been dewatered to the prescribed water content is removed by means of a prescribed handling unit. The resulting preform 1' has a thread formed on its neck. A thread excellent in sealing performance and other characteristics can be formed by dewatering the neck to a water content of 40 to 90 % by weight, particularly 70 to 90 % by weight (based on the dry weight).

Figures 7A, 7B, 7C:
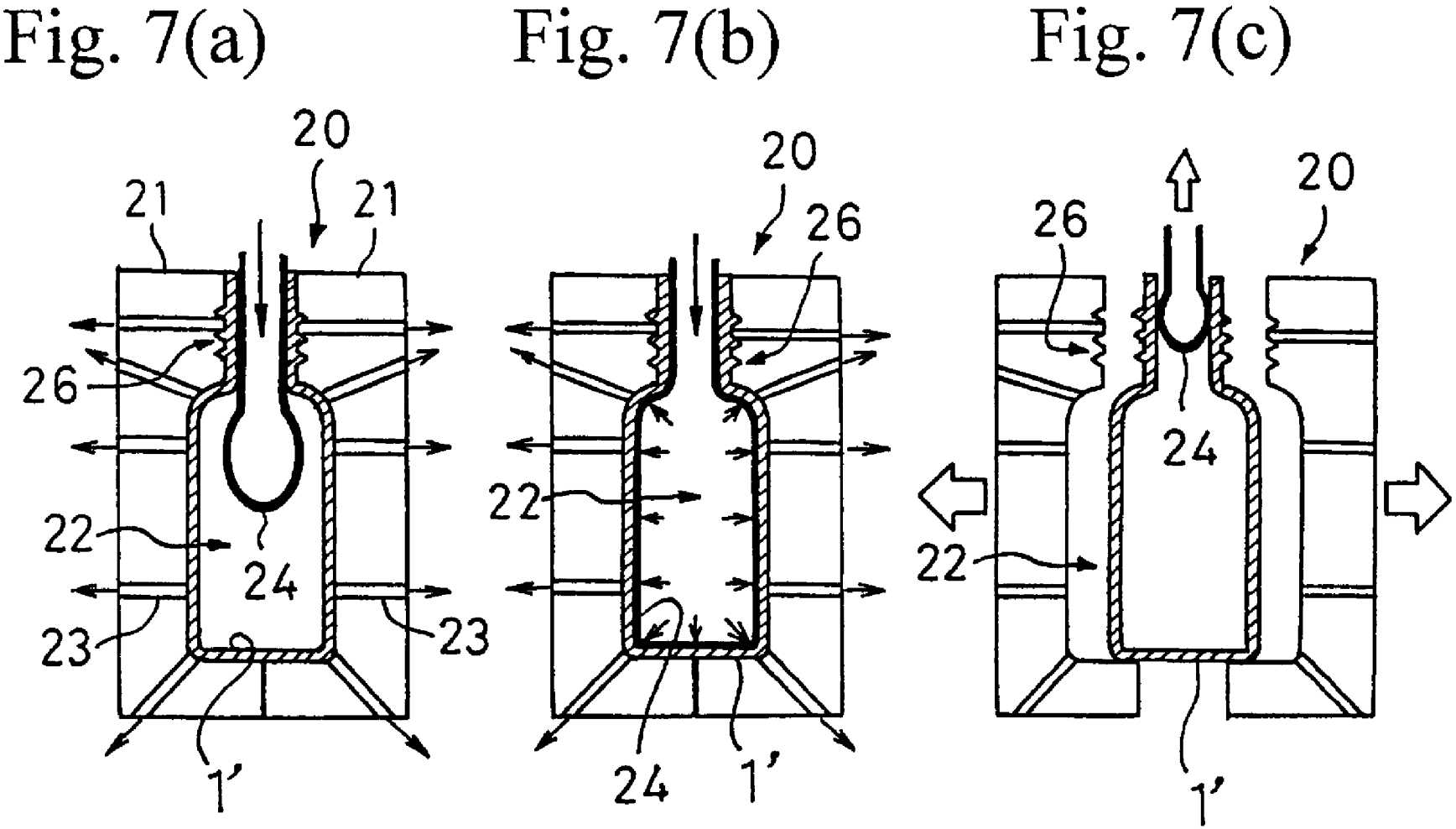
FIG. 7(*a*) shows the step of inserting a pressing member.

The preform 1' taken out is then subjected to the step of heat drying. FIGS. 7(*a*) through 7(*c*) show the heat drying step in order. FIG. 7(*a*) is the step of inserting a pressing member; FIG. 7(*b*) the step of heat drying; and FIG. 7(*c*) the step of opening the heating mold.

A heating mold 20 which is made up of a pair of split pieces 21 and 21 is separately prepared, the pieces 21 being joined together to form a cavity 22 having a shape in conformity to the contour of a molded article 1' to be produced. The heating mold is previously heated to a prescribed temperature. In this embodiment, the cavity shape of the heating mold is the same as that of the papermaking mold. The water-containing preform 1' having been dewatered to the prescribed water content is fitted into the cavity of the heated heating mold by means of a prescribed handling unit.

There is not a net on the inner surface of the cavity 22. Each of the split pieces 21 has a plurality of interconnecting passageways 23 which connect the inside thereof (the inner wall of the cavity 22) and the outside. Each interconnecting passageway 23 is connected to a suction means (not shown), such as a suction pump.

The heating mold has a thread 26 satisfying relationships (4) and (5) shown below formed on its cavity wall in the portion mating with the thread 5' of the preform 1' (hereinafter referred to as a mating thread).

The mating thread 26 satisfy the following relationships (4) and (5), where the length of the contour line of the mating thread observed via a cross-section along its width direction is taken as s (mm), and the width of the thread as viewed via a plane is taken as w (mm). By use of the heating mold 20 having the mating thread 26 satisfying these relationships, the thread 5' can be formed in accurate conformity with the shape of the mating thread 26, the thread 5' is prevented from breaking, the thread 5' can be formed with a smooth surface, and the density of the thread 5' is increased.

$$1 < s/w \leqq 1.5 \quad (4)$$

$$0 < w \leqq 10 \text{ mm} \quad (5)$$

It is still preferred for the mating thread 26 to satisfy relationship (4'):

$$1 \leqq s/w \leqq 1.3 \quad (4')$$

The flank angle θ' of the mating thread 26, which is equivalent to the flank angle θ of the thread 5' is preferably greater than 0° and smaller than 90°. The angle of the mating thread 26 facing the corner 5*a* of the thread 5' (i.e., the angle made by the mold inner surface facing the base plane B of the neck 2' of the molded article and the flank of the mating thread 26) preferably has a radius curvature R' of 0.1 mm or more, particularly 0.3 to 5 mm.

An expandable hollow pressing member 24 is inserted in its shrunken state into the preform 1' while evacuating the heating mold 20 as shown in FIG. 7(*a*). The term "expandable" as used herein means that (1) the pressing member 24 elastically stretches and contracts to change its capacity or (2) the pressing member 24 is not stretchable per se but is capable of changing its capacity with a fluid fed inside thereof or discharged outside. The former expandable member is made of an elastic material, such as natural rubber, urethane rubber, fluororubber, silicone rubber and elastomers. The latter expandable member can be of flexible materials, such as plastic materials (e.g., polyethylene and polypropylene), films of such plastic materials having aluminum or silica deposited thereon, films of such plastic materials laminated with aluminum foil, papers, fabrics, and the like. In the present embodiment, a balloon-like bag made of an inflatable elastic material is used as a pressing member 24.

As shown in FIG. 7(*b*), a prescribed pressurizing fluid is fed into the pressing member 24 to inflate the pressing member 24, and the inflated pressing member 24 presses the wet preform 1' toward the inner surface of the heating mold 20, i.e., the inner wall of the cavity 22. Thus the preform 1' is dried, and the inner shape of the cavity 22 is transferred to the preform 1' simultaneously. The mating thread 26 of the heating mold 20 satisfying relationships (4) and (5), the pulp fiber layer deposited in the grooves of the mating thread 26 is stretched to the length s of the contour line of the mating thread 26. As a result, the deposited pulp fiber layer can be pressed sufficiently without breakage even if the projections corresponding to the thread is formed in the deposited pulp fiber layer. In addition, the shape of the mating thread 26 is precisely transferred while increasing the density of the deposit pulp fiber layer in the grooves of the mating thread 26. Therefore, the thread 5' of the resulting molded article 1' is a satisfactory reproduction of the configuration of the mating thread 26, the thread 5' has a smooth surface, and the thread 5' has increased strength.

The pressurizing fluid which can be used to expand the pressing member 24 includes air (pressurizing air), hot air (heated pressurizing air), superheated steam, oil (heated oil), and other various liquids. From the standpoint of operating convenience, it is preferable to use air, hot air or superheated steam. The pressurizing fluid is preferably fed under a pressure of 0.01 to 5 MPa, particularly 0.1 to 3 MPa.

It is effective for forming the thread 5' with excellent sealing properties and other characteristics that the heating mold 20 has satisfactory capability of liberating air (steam generated on heating) particularly in the portion corresponding to the neck.

After the preform (molded article) 1' has been dried sufficiently, the fluid is withdrawn from the pressing member 24, and the pressing member 24 is let to shrink and taken out as shown in FIG. 7(*c*). The heating mold 20 is opened to take out the molded article 1' by means of a prescribed handling unit. The thread 5' on the neck 2' of the resulting molded article 1' satisfies relationships (1) and (2) or (3), representing an accurate reverse reproduction of the shape of the depressions on the heating mold. The thread 5' has a smooth surface, an increased density, and increased strength.

Another preferred method of producing the molded article according to the present invention will then be described. The method will be described only with regard to differences from the above-described one. The detailed description about the foregoing method appropriately applies to the same particulars The method comprises feeding a pulp slurry to a cavity of a papermaking mold composed of a set of split pieces, which are joined together to form a cavity of prescribed shape, to form a water-containing preform on the cavity wall (molding surface of the cavity), inserting an expandable hollow pressing member into the preform, and feeding a prescribed fluid into the pressing member to expand the pressing member thereby pressing the preform by the expanded preform toward the cavity wall (molding surface) to carry out dewatering.

The papermaking mold used in this method has the same structure as shown in FIG. 6(*a*), having a mating thread in the portion mating with the thread of the molded article. The pressing member to be used for press dewatering the preform can be the same as shown in FIG. 7(*a*). The fluid for expanding the pressing member and the fluid feed pressure can be the same as in the above-described method.

After the preform is dewatered to a prescribed water content, and the shape of the cavity wall is sufficiently transferred to the preform, the fluid is withdrawn from the pressing member to let the pressing member to shrink. The shrunken pressing member is removed from the preform. The papermaking mold is opened, and the wet preform having the prescribed water content is taken out by means of a prescribed handling unit. The resulting preform has a thread formed on its neck.

The preform thus taken out is then subjected to a heat drying step. The heat drying step is carried out almost in the same manner as for the aforementioned press dewatering step using a pressing member, except that papermaking and dewatering are not conducted, and a heating mold heated to a prescribed temperature is used. That is, a heating mold made up of a set of split pieces is separately prepared, the split pieces being joined together to form a cavity having a shape in conformity to the contour of a molded article to be produced. The heating mold is previously heated to a prescribed temperature. The wet preform having been dewatered to a prescribed water content is fitted into the cavity of the heated heating mold by means of a prescribed handling unit.

A pressing member which is different from that used in the press dewatering step in shape and/or material, etc. is inserted into the preform. A fluid is fed into the pressing member to expand it. The expanded pressing member presses the preform onto the cavity inner wall. The material of the pressing member and the fluid feed pressure can be the same as those used in the press dewatering step. In this state, the preform is dried by the heat. Thereafter, the same operations as in the aforementioned method are followed.

The present invention is not limited to the above-mentioned embodiments. For example, a pulp molded article satisfying relationships (1) and (2) or (3) can be produced by methods other than the aforementioned ones. For example, while in the above-described methods the screw thread is formed by completely filling the grooves of a mating thread satisfying relationships (4) and (5) with pulp fiber by pressing with a pressing member, it is possible to use a heating mold having a mating thread which satisfies relationship (5) but has deeper grooves than the mating thread used in the aforesaid embodiments. In this case, a molded article having a thread satisfying relationships (1) and (2) or (3) can be produced by appropriately adjusting the degree of pressing pulp fiber so that a thread may be formed with the grooves of the mating thread not being completely filled with pulp fiber.

EXAMPLES

The present invention will now be illustrated in greater detail by way of Examples, but it is a matter of course that the scope of the present invention is not limited thereto.

Example 1

A pulp molded article was produced by the method shown in FIGS. 6(*a*) to 6(*c*) and 7(*a*) to 7(*c*). A pulp slurry containing NBKP/LBKP (=50 wt %/50 wt %) was used. A paper strengthening agent, aluminum sulfate, a sizing agent, a yield improving agent, and the like were added to the slurry, and the concentration was adjusted to 1 wt %. The contour and dimensions of the thread on the neck of the resulting molded article are shown in Table 1.

Examples 2 to 5

Pulp molded articles were produced in the same manner as in Example 1 with 15 the following exception. In Example 2, the neck of the molded article was laminated with a polyester shrink film. In Example 3, the neck of the molded article was coated with an acrylic resin emulsion. In Example 4, the neck of the molded article was impregnated with a 50 wt %/50 wt % mixture of an acrylic resin emulsion and a melamine resin emulsion. In Example 5, a pulp slurry containing 30 wt % polyethylene fiber was used. The contour and dimensions of the thread on the neck of the resulting molded articles are shown in Table 1.

Comparative Example 1

A paper cylinder (available from Shofudo; outer diameter: 70 mm; number of turns: 1.25; number of threads: 6.23 mm/inch; thread width: 3.5 mm) was used.

Evaluation of Performance:

The resulting molded articles were evaluated for overrun torque, pull-out strength, center-line average roughness of the neck, surface strength of the neck by the wax pick method, and durometer hardness of the neck in accordance with the following methods. The transverse compressive strength and the density were measured according to the previously described methods. The seal between the neck and a cap and the degree of fiber rising on the neck after repeated capping and uncapping were measured by the following methods. The results obtained are shown in Table 1.

1. Overrun torque

Measurement was made with a torque gauge (Mechanical Torque Meter 2-TM75, supplied by TOHNICHI). The cap of "Wide Hiter" available from Kao Corp. was used. The cap was screwed on by hand, and the overrun torque (clamping torque) of the cap was measured.

2. Pull-out strength

A jig attachable to a tensile tester was attached to the cap. The cap was screwed on the molded article to a clamping torque of 3 N·m measured with the above-described torque gauge and pulled by the tensile tester at a speed of 20 mm/min. The force when the cap was pulled apart the molded article was measured.

3. Center-line average roughness of neck

Measured with a surface profilometer (Surfcom 120A, available from Tokyo Seimitsu Co., Ltd.).

4. Surface strength of neck by wax pick method

The surface strength was measured in accordance with JIS P8129. Wax (rated 2A to 20A) was applied by fusion to the surface of the neck and pulled off when cool. The highest number wax that did not disturb the surface of the neck was taken as a surface strength grade. A higher wax number indicates higher surface strength. However, this method is unapplicable to molded articles coated with a thermoplastic resin or impregnated with a large amount of a thermoplastic resin.

5. Durometer hardness of neck

Durometer hardness is a measure of resistance to collapse of the part under test. Here, it is used as a measure of resistance to strength reduction of the neck. Durometer hardness was measured in accordance with JIS K7215. A rubber hardness tester (GS-809 available from Teclock Corp.; Shore A type) was used. The hardness was calculated from formula (A):

$$100-40\times h \quad \text{(A)}$$

where h represents the depth (mm) of penetration.

Method of measurement:

The molded article was set vertical. The indentor of the rubber hardness tester held by hand was pressed horizontally to the outer peripheral surface of the threaded neck. The depth (mm) of penetration in one second pressing was measured. An average depth of penetration in 10 measurements (n=10) as calculated by formula (A) was taken as a durometer hardness. In case where the molded article had a thin and soft wall, the indentor was pressed onto a specimen cut out of the molded article and placed on a glass plate. If necessary, a D type tester was used, or where the test piece is too thin for measurement, a stack of several thicknesses was measured.

6. Seal between neck and cap

The molded article was filled with Wide Hiter (a trade name of a bleaching powder available from Kao Corp.), and the cap was screwed on to a clamping torque of about 1.47 N·m (15 kgf·cm) measured with the torque gauge. The molded article held upside down was given ten vertical shakings and placed on its base. The cap was screwed off, and adhesion of powder to the outer surface of the neck of the molded article, the threaded part of the inner surface of the cap, and the like was observed with the naked eye.

7. Degree of fiber rising on neck after repeated capping and uncapping

The cap was screwed on and off repeatedly, and the degree of fiber rising on the neck was observed with the naked eye.

TABLE 1

| | Threaded Part | | | | | | | |
|---|---|---|---|---|---|---|---|---|
| | Contour | Height H (mm) | Effective Number of Turns | Thickness of Neck (mm) | Threads per inch | Width W (mm) | Overrun Torque (N · m) | Pull-out Strength (N) |
| Ex. 1 | trap-ezoidal | 1.0 | 1 | 0.6 | 3.18 | 2.5 | ≧5.0 | ≧196 |
| Ex. 2 | trap-ezoidal | 1.0 | 1 | 0.8 | 3.18 | 2.5 | ≧5.0 | ≧196 |
| Ex. 3 | trap-ezoidal | 1.0 | 1 | 0.8 | 3.18 | 2.5 | ≧5.0 | ≧196 |

TABLE 1-continued

| | | | | | | | | |
|---|---|---|---|---|---|---|---|---|
| Ex. 4 | trap-ezoidal | 1.0 | 1 | 0.7 | 3.18 | 2.5 | ≧5.0 | ≧196 |
| Ex. 5 | trap-ezoidal | 1.0 | 1 | 0.7 | 3.18 | 2.5 | ≧5.0 | ≧196 |
| Comp. Ex. 1 | rounded | 0.25 | 1.25 | 1.1 | 6.23 | 3.5 | <1.0 | ≦3 |

| | Neck | | | | | | Number of Times of Repetition of |
|---|---|---|---|---|---|---|---|
| | Ra (μm) | Surface Strength* | Hardness** | Transverse Compressive Strength (N) | Density (g/cm$^3$) | Seal between Neck and Cap | Capping/Un-capping Causing Fiber Rising |
| Ex. 1 | 3.3 | 10A | 90 | 36.5 | 0.85 | no powder leak | 20 |
| Ex. 2 | 0.4 | — | 92 | 38.2 | 0.85 | no powder leak | No fiber rising occurred |
| Ex. 3 | 1.0 | — | 92 | 39.8 | 0.80 | no powder leak | 100 or more |
| Ex. 4 | 1.8 | — | 95 | 51.1 | 0.82 | no powder leak | 100 or more |
| Ex. 5 | 3.0 | 18A | 97 | 48.3 | 0.86 | no powder leak | 100 or more |
| Comp. Ex. 1 | 6.5 | 5A | 90 | 17.2 | 0.89 | powder leak | 5 to 6 |

*Wax pick method
**Durometer hardness

As is apparent from the results shown in Table 1, the pulp molded articles of Examples 1 to 5 (the products of the present invention) exhibit a good seal between the neck and the cap. It is seen, in particular, that the molded articles of Examples 2 to 5 having a resin added externally or internally to their neck are prevented from being raised on their neck after repetition of capping and uncapping.

Example 6

A plastic molded article of the same shape and size as the container of Example 1 was prepared. A plastic cap (the one used in Wide Hiter available from Kao Corp.) was screwed on each of the pulp molded article of Example 1 and the plastic molded article to a clamping torque of 2.0 N·m (20 kgf·cm) with the torque gauge. Immediately thereafter, the opening torque was measured.

The opening torque of the pulp molded article of Example 1 was 1.96 to 2.45 N·m, indicating a torque loss of 0.49 to 0.98 N·m (16 to 30%), whereas the opening torque of the plastic molded article was 0.98 to 1.47 N·m, indicating a torque loss of 1.47 to 1.96 N·m (50 to 66%).

INDUSTRIAL APPLICABILITY

The pulp molded article according to the present invention secures a good seal with a cap. The pulp molded article of the present invention exhibits improved durability against repeated capping and uncapping.

The pulp molded article of the present invention assures an accurate reproduction of the depressions on the molding surface of a mold and exhibits sufficiently high strength in the threaded part thereof

The invention claimed is:

1. A pulp molded article comprising a neck portion and a thread provided on an outer surface of said neck portion, the neck portion including an outwardly curled upper edge, the neck portion being formed to withstand an overrun torque of 1 Nm or higher.

2. The pulp molded article according to claim 1, wherein said thread has a height of 0.3 mm or more and an effective number of turns of 0.75 or more.

3. The pulp molded article according to claim 1, wherein the thread is configured to withstand a pull out force of 5N or greater.

4. The pulp molded article according to claim 1, wherein said neck portion inclusive of said thread has a center-line average roughness of 50μm or smaller.

5. The pulp molded article according to claim 1, wherein said neck portion inclusive of said thread has a resin added externally or internally.

6. The pulp molded article according to claim 1, wherein said neck portion has a transverse compressive strength of 20N or greater.

7. The pulp molded article according to claim 1, wherein said neck portion has a screw blocking projection for preventing excessive engagement over a prescribed amount between said thread of said neck portion and a thread of a threaded cap.

8. A pulp molded article, comprising:

a neck portion including an outwardly curled edge;

a body portion; and at least one thread is provided on a surface of the neck, wherein the outwardly curled edge is configured to withstand an overrun torque of at least 1 Nm.

9. The pulp molded article according to claim 8, wherein the at least one thread satisfies at least two of the following equations:

$$1<S/W \leqq 1.5;$$

$$0<W \leqq 10t; \text{ and}$$

$$0<W<10 \text{ mm},$$

wherein S is a width of the at least one thread, W is a height of the at least one thread, and t is a thickness of a wall of the neck portion.

10. The pulp molded article according to claim 8, wherein the at least one thread is shaped as at least one of a trapezoid, a triangle, a square, or a semicircle.

11. The pulp molded article according to claim 8, wherein at least one of an exterior and an interior of the pulp molded article is coated with a resin.

12. The pulp molded article according to claim 8, wherein the neck portion has a wax pick grade of at least 5A.

13. The pulp molded article according to claim 8, wherein the pulp molded article is impregnated with a resin.

14. A method of forming a pulp molded article, comprising:

pouring a predetermined amount of pulp slurry into a cavity of a mold, the mold including a body portion and a neck portion having at least one thread form thereon;

evacuating the cavity of excess fluid, thereby depositing a preform layer of pulp slurry on the cavity of the mold;

dewatering the preform;

curling an upper edge of the neck portion to form a lip; and drying the preform.

15. The method according to claim 14, wherein the forming comprises forming at least one thread satisfying at least two of the following equations:

$$1<S/W\leqq 1.5;$$

$$0<W\leqq 10t;\text{ and}$$

$$0<W<10\text{ mm},$$

wherein S is a width of the at least one thread, W is a height of the at least one thread, and t is a thickness of a wall of the neck portion.

16. The method according to claim 14, wherein the forming comprises forming a thread shaped as at least one of a trapezoid, a triangle, a square, or a semicircle.

17. The method according to claim 14, further comprising coating at least one of an interior and an exterior of the pulp molded article with a resin.

18. The method according to claim 14, further comprising outwardly curling an upper edge of the neck portion.

19. The method according to claim 18, wherein the outwardly curling integrates the upper edge of the neck portion with the at least one thread.

20. The method according to claim 14, wherein the dewatering comprises dewatering the preform using an inflatable pressing member.

21. A pulp molded article, comprising:

a neck portion;

a body portion; and at least one thread is provided on a surface of the neck, wherein the neck is configured to withstand an overrun torque of at least 1 Nm, wherein the at least one thread satisfies at least two of the following equations:

$$1<S/W\leqq 1.5;$$

$$0<W\leqq 10t;$$

$$0<W<10\text{ mm},$$

wherein S is a width of the at least one thread, W is a height of the at least one thread, and t is a thickness of a wall of the neck portion.

22. A method of forming a pulp molded article, comprising:

pouring a predetermined amount of pulp slurry into a cavity of a mold, the mold including a body portion and a neck portion having at least one thread form thereon;

evacuating the cavity of excess fluid, thereby depositing a preform layer of pulp slurry on the cavity of the mold;

dewatering the preform; and drying the preform, wherein the forming comprises forming at least one thread satisfying at least two of the following equations:

$$1<S/W\leqq 1.5;$$

$$0<W\leqq 10t;$$

$$0<W<10\text{ mm, and}$$

wherein S is a width of the at least one thread, W is a height of the at least one thread, and t is a thickness of a wall of the neck portion.

* * * * *